US008112951B2

(12) United States Patent
Gravel

(10) Patent No.: US 8,112,951 B2
(45) Date of Patent: Feb. 14, 2012

(54) PERMANENT FORM ASSEMBLY AND METHOD FOR SWIMMING POOL USER SUPPORT STRUCTURES

(76) Inventor: Roger Gravel, Manchester, NH (US)

( * ) Notice: Subject to any disclaimer, the term of this patent is extended or adjusted under 35 U.S.C. 154(b) by 132 days.

(21) Appl. No.: 12/574,143

(22) Filed: Oct. 6, 2009

(65) Prior Publication Data

US 2011/0078962 A1 Apr. 7, 2011

(51) Int. Cl.
*E04F 11/00* (2006.01)

(52) U.S. Cl. ..... 52/182; 52/741.2; 52/741.14; 52/169.7

(58) Field of Classification Search ..... 52/182, 52/184, 188, 741.2, 741.14, 169.7, 169.8; 4/496, 506; 249/14, 19
See application file for complete search history.

(56) References Cited

U.S. PATENT DOCUMENTS

| | | | | |
|---|---|---|---|---|
| 2,537,396 | A * | 1/1951 | Cato | 249/14 |
| 2,610,380 | A * | 9/1952 | Pollman | 249/14 |
| 2,617,764 | A | 11/1952 | Hauber et al. | |
| 3,284,042 | A * | 11/1966 | Ingalise | 249/14 |
| 3,374,491 | A | 3/1968 | Patin et al. | |
| 3,744,198 | A | 7/1973 | Boassy | |
| 3,848,378 | A | 11/1974 | Witte | |
| 4,343,120 | A | 8/1982 | Witte | |
| 5,010,699 | A | 4/1991 | Maiuccoro et al. | |
| 5,086,595 | A | 2/1992 | Maiuccoro et al. | |
| 5,186,874 | A * | 2/1993 | McLaughlin | 264/35 |
| 5,644,873 | A | 7/1997 | Bourgault | |
| 5,916,099 | A | 6/1999 | Hall | |
| 5,941,030 | A | 8/1999 | Williamson | |
| 6,408,577 | B1 | 6/2002 | Desjoyaux et al. | |
| 7,040,060 | B2 | 5/2006 | Cox | |
| 7,150,129 | B2 * | 12/2006 | Elder et al. | 52/184 |
| 2003/0070369 | A1 | 4/2003 | Dillen, II et al. | |
| 2003/0106743 | A1 | 6/2003 | St-Pierre et al. | |
| 2004/0144044 | A1 | 7/2004 | Cox | |
| 2006/0248817 | A1 | 11/2006 | Elwood | |
| 2008/0120928 | A1 | 5/2008 | St-Pierre | |

OTHER PUBLICATIONS

Catalog, Cardinal Systems, Schuylkill Haven, PA.

* cited by examiner

*Primary Examiner* — Jessica Laux
(74) *Attorney, Agent, or Firm* — Robert R. Deleault, Esq.; Mesmer & Deleault, PLLC

(57) ABSTRACT

A permanent form assembly and method for creating and forming swimming pool user support structures within a swimming pool includes one or more of a vertical elongated support, one or more of a lateral brace, and a plurality of support structure risers that when assembled create a permanent support structure form having a volume for receiving a filler within the volume.

17 Claims, 9 Drawing Sheets

PERMANENT FORM ASSEMBLY AND METHOD FOR SWIMMING POOL USER SUPPORT STRUCTURES

BACKGROUND OF THE INVENTION

1. Field of the Invention

The present invention relates generally to swimming pools. Particularly, the present invention relates to user support structures within swimming pools.

2. Description of the Prior Art

In-ground swimming pools naturally have sides or sidewalls that are substantially vertical. The average swimming pool has vertical sidewalls that extend downwardly several feet from an upper surface of the pool deck. To facilitate entering and exiting a swimming pool, a swimming pool has some sort of ladder, steps, or the like to assist one in getting into and out of the pool. Generally, permanent steps are provided at a shallow end of in-ground swimming pools. In some pools, a swimmer's bench may also be included along a portion of a vertical sidewall typically in the shallow end. The bench provides a structure in the swimming pool where a swimmer may sit and relax while remaining in the water without having to tread water or to stand whereby the swimmer's upper torso is completely out of the water.

Presently, it is relatively common to use various types of interior steps or stairs in a swimming pool for swimmers to gain access to and exit the swimming pool. A well recognized style of interior steps is known as a "wedding cake" step form. In certain types of swimming pools such as ones constructed of concrete or gunite, permanent interior steps and or benches are often built on site by constructing a step or bench form. The step or bench form is filled with concrete and, when the concrete has set and dried, the step or bench form is removed. The cost of manufacturing concrete steps is expensive and labor intensive, requiring highly skilled workers for construction. A concrete step, however, is advantageous for concrete or gunite type pools and when there is a need for variations in the step shape or size.

A problem is presented when concrete steps are used for vinyl liner type swimming pools. With these type of pools, it is difficult to accurately measure and build a conforming liner to cover the concrete steps due to the variability and the unique shapes and sizes of poured concrete steps.

As an alternative to poured concrete steps, on-piece molded plastic steps have been designed and used. These prefabricated step modules are carried to the site and readily installed. One type of step module is formed of acrylic and/or fiberglass laminates or vinyl covered metal. These types of step modules are relatively strong and will generally adequately support the weight of an adult. The drawback to such step modules is their tendency to delaminate, splinter, corrode, or puncture.

Because of these problems and other considerations, stair modules are now predominantly prefabricated, unitary structures formed from some type of suitable plastic composite or the like that can withstand temperature related expansion and contraction. Such materials, however, are generally relatively flexible so that the steps may yield under a person's weight, thereby giving the person an insecure feeling. Additionally, the structural integrity of such stair modules may be compromised.

There have been devised various support structures to reinforce the steps of such prefabricated plastic stair modules. Stacked blocks or bricks have been used for support, but this requires footers and building the support from the ground up requiring shims for leveling. Other examples of such support structures may include support posts having bearing plates or pads connected to their upper ends which are placed under the stair tread, or a longitudinal stiffening member which is bonded to the pieces at a serrated surface on the underside of the stair tread. Another type of known support structure includes unitary support braces formed of a suitable plastic material which are strategically situated under the stair module treads. Each support brace has a plurality of horizontal step supports corresponding in number to the stair treads. Extending vertically from the horizontal step supports are integral tabs that are positioned to register unto slots formed within transverse stiffening ribs on the underside of the stair treads.

Therefore, what is needed is permanent form system that can accommodate many sizes and styles of swimming pool stairs and benches.

SUMMARY OF THE INVENTION

It is an object of the present invention to provide permanent form system that can accommodate many sizes and styles of swimming pool user support structures including, but not limited to, stairs, benches and combinations thereof. It is another object of the present invention to provide a permanent form system that does not require highly skilled workers of construction. It is a further object of the present invention to provide a permanent swimming pool user support structures that are relatively inexpensive and easy to install.

The present invention achieves these and other objectives by providing a permanent form system and method for creating and forming swimming pool user support structures within an in-ground swimming pool that uses vinyl liners.

The permanent form system of the present invention may be an assembly or a kit. The difference is that the assembly is already assembled while the kit requires assembly.

In one embodiment of the present invention, the permanent form assembly is a permanent form kit. The kit includes one or more of a vertical elongated support, one or more of a lateral brace, a plurality of support structure risers, and a plurality of fasteners. The one or more of a vertical elongated support has a pool wall flange extending laterally from the vertical support that is adapted for fixedly securing the pool wall flange to one of a pool wall or a vertical support brace. The one or more of a lateral brace has a longitudinal brace body, a vertical support end connected to the vertical elongated support and a riser support end where the lateral brace is adapted to extend laterally from the pool wall. Each of the risers has a riser inside surface, a smooth riser outside surface, a first riser end, and a second riser end. The first riser end is adapted for fixedly securing to the riser support end of the lateral brace and the second riser end is adapted for fixedly securing to one of a first riser end of another support structure riser, the pool wall or the riser outside surface of another support structure riser.

In another embodiment of the present invention, there is included a support brace having first and second support brace ends adapted to directly attach one of the first and second support brace ends to one of a pair of intersecting pool walls. The support brace also includes a central support brace portion adapted for fixedly attaching to the vertical elongated support.

In still another embodiment of the present invention, the lateral brace is integrally-formed with the vertical elongated support from a single piece of material.

In a further embodiment of the present invention, each of the plurality of support structure risers has either a hem or a bracing flange formed along a longitudinal edge.

In yet another embodiment of the present invention, each of the plurality of risers has a first riser end flange that extends laterally from the riser inside surface at first and second riser ends.

In another embodiment of the present invention, the lateral brace includes a riser spacing slot that is adapted for receiving a longitudinal side of one of the plurality of support risers.

In another embodiment of the present invention, the permanent form assembly includes a vertical brace support that is adapted to attach and support one or more of the lateral braces along the longitudinal brace body of the lateral brace.

The structure of the permanent form assembly is such that, when a filler is disposed within the space created by the permanent form assembly, the only visible component is the outside surface of the risers. The filler forms a platform that functions as the stair tread in a stair-style assembly and as a seat surface in a bench-style assembly.

DETAILED DESCRIPTION OF THE PREFERRED EMBODIMENT

Figure 1:
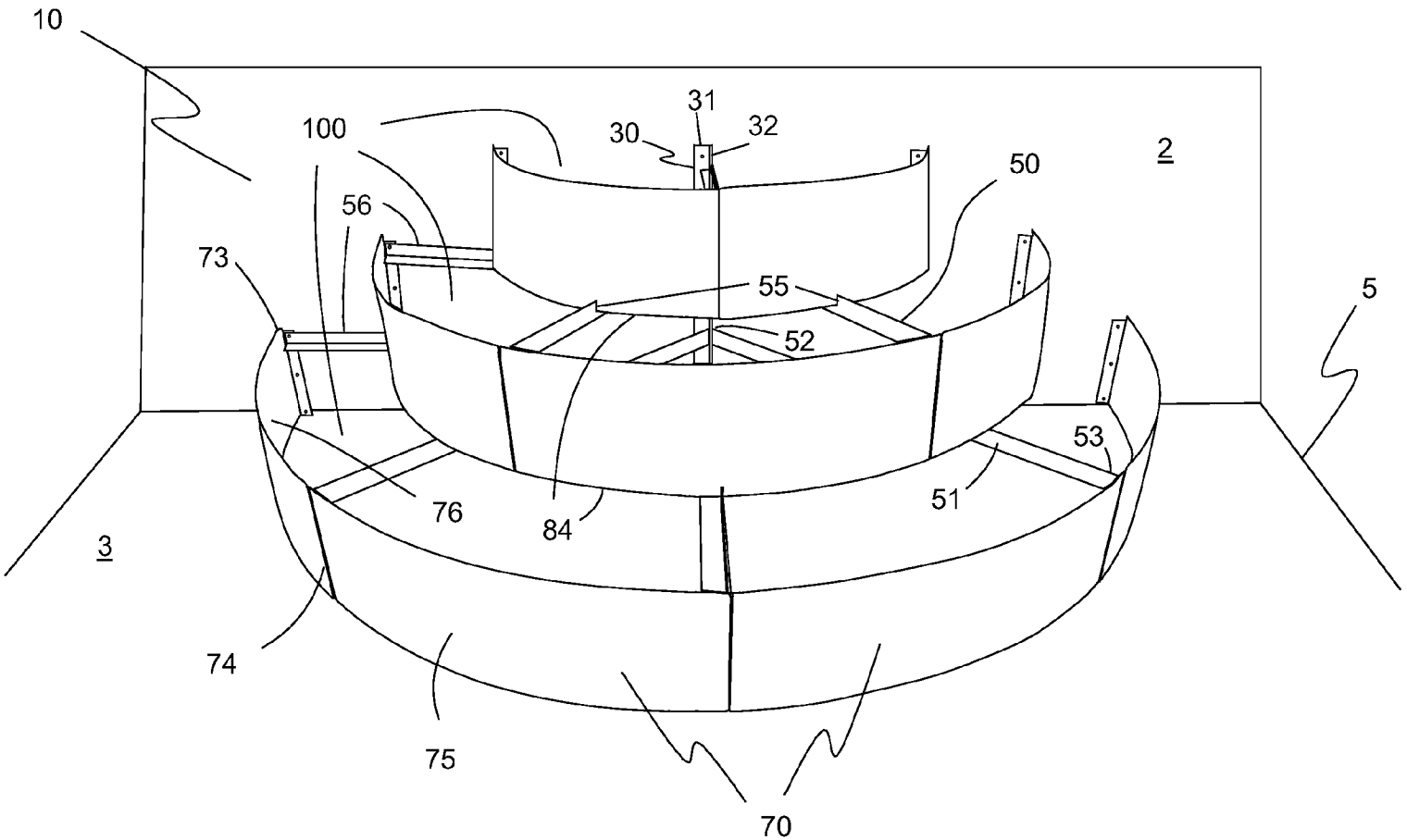
FIG. 1 is a front perspective view of one embodiment of the present invention showing a permanent form for pool stairs along a side of a pool.

The preferred embodiment(s) of the present invention is illustrated in FIGS. 1-14. FIG. 1 shows one embodiment of a permanent form 10 for creating a swimming pool user support structure. Permanent form assembly 10 includes one or more of a vertical, elongated support 30, one or more of a lateral brace 50 and a plurality of support structure risers 70. Permanent form assembly 10 is shown fixedly attached to a flat wall 2 of a swimming pool 5 that is used to create interior steps known as "wedding cake" steps. Vertical elongated support 30 and lateral brace 50 are generally made of a rigid material while the plurality of support structure risers 70 may be made of either rigid or bendable material, preferably bendable material.

Vertical elongated support 30 is fixedly attached to wall 2 of swimming pool 5 along its longitudinal length with one end (not shown) of vertical elongated support 30 resting on a bottom 3 of swimming pool 5. Vertical elongated support 30 has a wall attaching surface 31 and a lateral brace connecting surface 32. Vertical elongated support 30 may be solid, tubular or angular. Preferably, vertical elongated support 30 is an angular bracket, more preferably an L-shaped bracket, such as a piece of angle iron having one flange of the L-shaped member connected to wall 2 and a second flange of the L-shaped member that is lateral to the first flange providing a connecting surface for lateral brace 50.

Lateral brace 50 has a longitudinal brace body 51, a vertical support end 52 and a riser support end 53. Lateral brace 50 is provided in various lengths based on the number of stairs to be installed. The first or lowest step has the longest lateral brace 50 in permanent form assembly 10 while the topmost step has the shortest lateral brace 50. Optionally, lateral brace 50 may include one or more riser spacing slots 55 in the longitudinal brace body 51. Riser spacing slot 55 is configured to receive a portion of a bottom longitudinal edge 84 of support structure riser 70. It is also contemplated that an optional lateral end brace 56 may be used if pre-assembly of the permanent form 10 is preferred. Optional lateral end brace 56, when used, would preferably be attached between the plurality of risers at the riser ends that attach to the pool wall. The use of optional lateral end braces 56 allows pre-assembly of the permanent mold assembly, which can then be easily placed into position before coupling to the pool wall and may facilitate the step-forming process.

Support structure riser 70 has a riser body 72 with a first riser end 73, a second riser end 74, an outside surface 75, and an inside surface 76. As can be seen from FIG. 1, support structure riser 70 has first riser end 73 connected to wall 2 or to a second riser end 74 of an abutting riser 70. Where two or more steps are formed, riser 70 of each additional step is supported along a bottom riser edge 84 by lateral brace 50 of riser 70 of the immediately lower step.

Permanent form assembly 10 creates a volume space 100 between wall 2 and inside surface 76 of the plurality of risers 70. A filler (not shown) is filled within space 100 to provide step platforms that function as stair risers and a strong form over which a pool liner (not shown) is installed. The filler may be poured concrete or a porous, loose-packed material with a poured concrete cap or platform over the porous, loose-packed material. Examples of porous, loose-packed material include stones, sand and the like.

Figure 2:
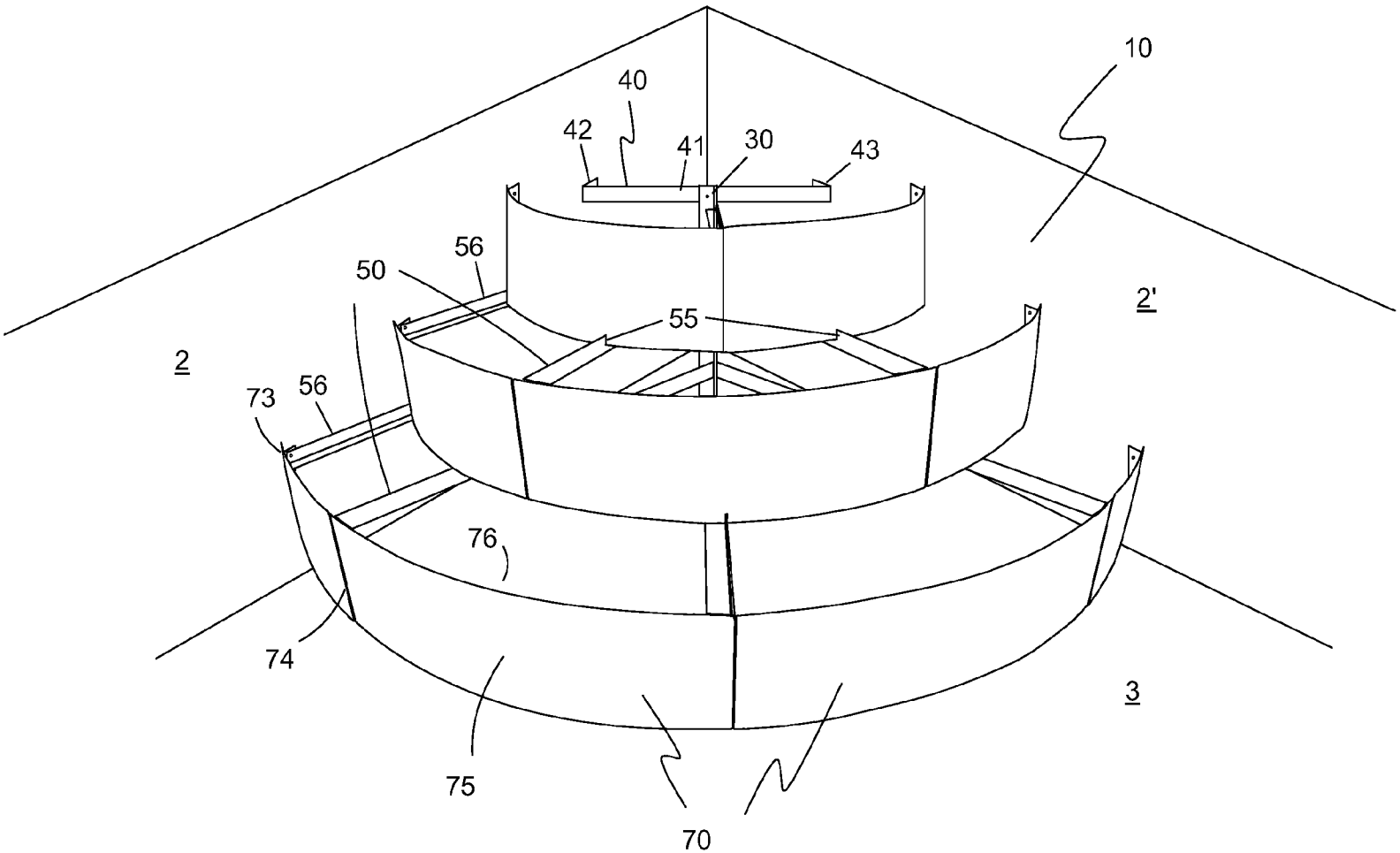
FIG. 2 is a front perspective view of another embodiment of the present invention showing a permanent form for pool stairs in a corner of a pool.

Turning now to FIG. 2, there is illustrated the embodiment shown in FIG. 1 adapted for use in a pool corner. Permanent form assembly 10 includes all of the same components as previously discussed, which are the vertical elongated support 30, the lateral brace 50 and a plurality of support structure risers 70. A cross support 40 is securely attached laterally to vertical elongated support 30. Cross support 40 has a cross support central portion 41, a first cross support end 42 and a second cross support end 43. Cross support central portion 41 is securely attached to wall attaching surface 31 of vertical elongated support 30 while first cross support end 42 is securely attached to wall 2 and second cross support end 43 is securely attached to wall 2'. One or more of cross support 40 may be used to stabilize vertical elongated support 30 before the filler is placed within space 100. Like FIG. 1, optional lateral end braces 56 are shown and may be used particularly when pre-assembly of the permanent form assembly is desired.

Figure 3:
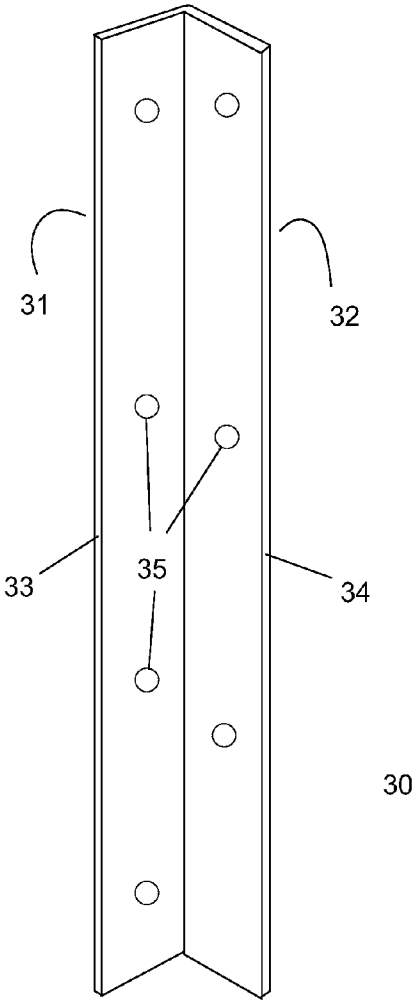
FIG. 3 is a perspective view of one embodiment of a lateral brace or a vertical support of the present invention.

FIG. 3 shows one embodiment of vertical elongated support 30. In this embodiment, vertical elongated support 30 is an angularly-shaped member having wall support flange 33 with wall support surface 31 and a brace support flange 34 with a brace support surface 32 that extends laterally from wall support flange 33. A plurality of openings 35 may optionally be included in wall support flange 33 and brace support flange 34 to facilitate the assembly of permanent form assembly 10. It should be understood that vertical elongated support 30 may have other shapes such as U-shaped, V-shaped, tubular-shaped or any configuration that presents at least one wall support surface 31 and one or more brace support surfaces 32 capable of securely attaching the vertical support 30 to a swimming pool wall 2 or a cross support 40 and one or more lateral braces 50 to the vertical support 30.

Figure 4:
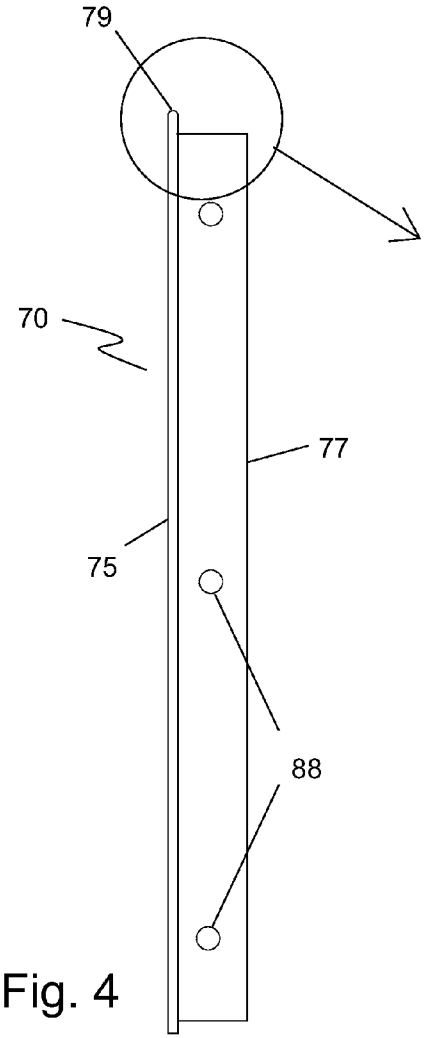
FIG. 4 is a side plan view of one embodiment of a riser of the present invention showing a laterally extending flange.

FIG. 4 shows a side view of one embodiment of riser 70. Riser 70 includes a riser outside surface 75 that is smooth and a riser lateral flange 77 that extends from second riser end 74. Riser lateral flange 77 is shorter than the height of riser 70 so that all of riser lateral flange 77 is contained with the space 100 when assembled in permanent form assembly 10. Riser lateral flange 77 may optionally include a plurality of riser flange openings 88 for receiving fasteners (not shown). On the opposite end (first riser end 73), there is also a riser lateral flange 78 that is similar to riser lateral flange 77. In one embodiment of riser 70, an optional top longitudinal edge 79 is formed by a hem 80.

Figure 5:
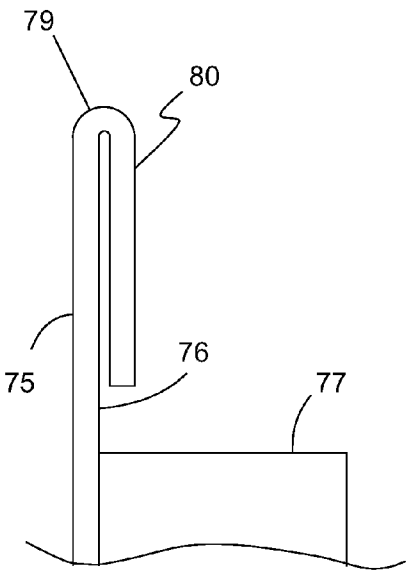
FIG. 5 is an enlarged partial view of the embodiment of the riser illustrated in FIG. 4 of the present invention showing a hemmed edge.

FIG. 5 shows an enlarged view of hem 80. Hem 80 is formed by bending the longitudinal side towards riser inside surface 76 onto itself to present a rounded top longitudinal edge 79. The purpose of hem 80 is to present a smooth riser edge transition from the smooth outside surface 75 so that no sharp edges are exposed to the pool liner (not shown) that will cover permanent form assembly 10. Alternately, the top edge 79 may be rounded by grinding, polishing, etc.

Figure 6:
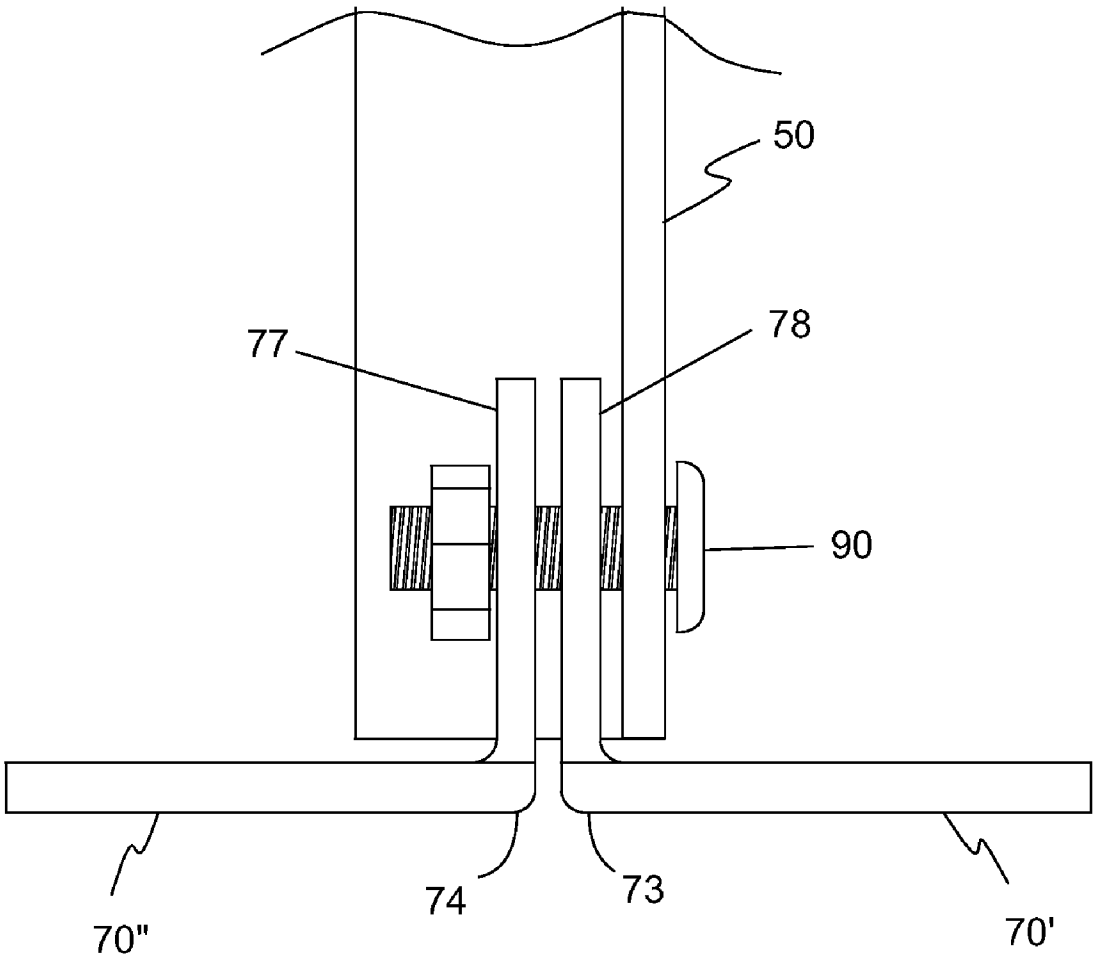
FIG. 6 is an enlarged top view of one embodiment of two adjacent risers showing the assembly of the risers to a lateral brace.

FIG. 6 shows an enlarged view of the connection point between a pair of adjacent risers 70 and a lateral brace 50. A fastener 90 fixedly secures riser lateral flange 78 of first riser end 73 of riser 70', riser lateral flange 77 of second riser end 73 of riser 70" and riser brace end 53 to each other. It should be understood that the position of lateral brace 50 and riser lateral flanges 77, 78 shown in FIG. 6 may be changed so that lateral brace 50 may be on either said of lateral flanges 77, 78 and, in the case where lateral brace 50 is not tubular but an angularly-shaped bracket with a brace flange 54, brace flange 54 may also be positioned between riser lateral flanges 77, 78. Any fastener known in the art may be used to secure the lateral brace ends 52, 53 to vertical support 30 and risers 70, respectively.

Figure 7:
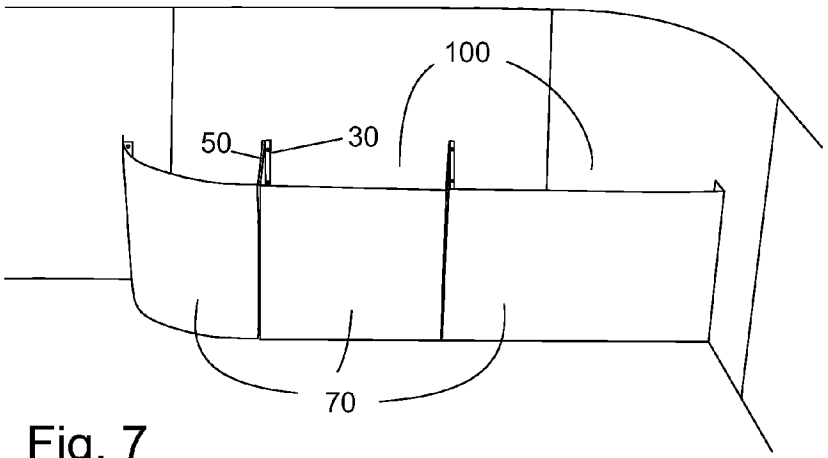
FIG. 7 is a front perspective view of another embodiment of the present invention showing an assembled permanent form for a bench in a swimming pool.

FIG. 7 illustrates another embodiment of the permanent form assembly of the present invention. In this embodiment, permanent form assembly 10' creates a bench within a swimming pool upon which a swimmer may sit and still remain in the water. Permanent form assembly 10' includes one or more of a vertical, elongated support 30, one or more of a lateral brace 50 and a plurality of support risers 70'. Although FIG. 7 shows a bench-style permanent form assembly 10' configured into a corner of a swimming pool, it should be appreciated that the bench-style permanent form assembly 10' may be along a middle portion of a straight wall 2, along two lateral walls 2, along a curved wall, or any combination since the preferred risers 70' can be easily bent to shape. Another embodiment of the vertical elongated support 30 and lateral brace 50, which is better shown in FIGS. 8 and 9, may be optionally used with the bench-style embodiment of FIG. 7.

Figure 8:
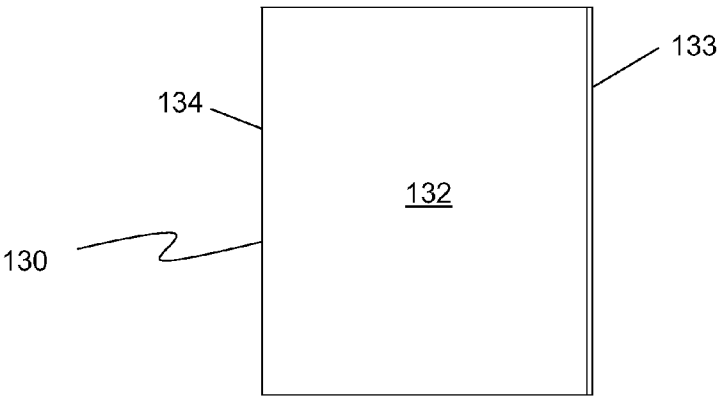
FIG. 8 is a front view of another embodiment of a brace of the present invention.
Figure 9:
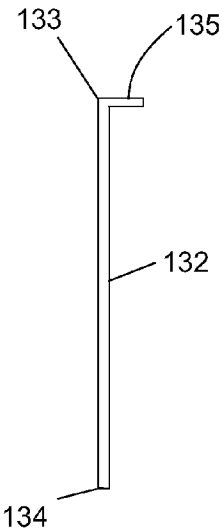
FIG. 9 is a top view of the brace shown in FIG. 8.

Turning now to FIG. 8, there is shown a front view of this alternate embodiment. Vertical elongated support 30 and lateral brace 50 are integrally formed and, preferably, are a unitary brace and support structure 130. Unitary brace and support structure 130 is typically formed from one material that has a planar body 132 and a lateral flange 135 along one of two opposing edges 133, 134. Planar body 132 performs the function of the lateral brace 50 while lateral flange 135 on edge 133 performs the function of the vertical elongated support 30 and opposing edge 134 performs the function of brace riser end 53. This is better shown in FIG. 9, which is a top view of unitary brace and support structure 130.

Figure 10:
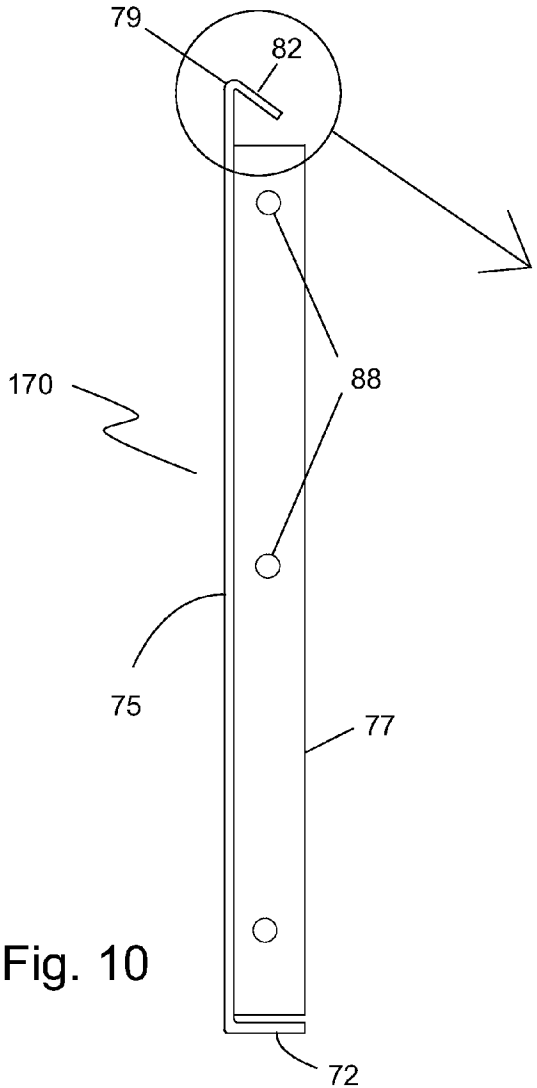
FIG. 10 is a side view of another embodiment of a riser of the present invention showing a lateral flange and a top edge flange.

Turning now to FIG. 10, there is illustrated a side view of an alternative riser 170 that is usable for straight step assemblies or straight risers for the bench-style permanent form assembly 10'. Riser 170 includes a riser outside surface 75 that is smooth and a riser lateral flange 77 that extends from second riser end 74. Riser lateral flange 77 is shorter than the height of riser 170 so that all of riser lateral flange 77 is contained within the space 100 when assembled in permanent form assembly 10'. Riser lateral flange 77 may optionally include a plurality of riser flange openings 88 for receiving fasteners (not shown). On the opposite end (first riser end 73), there is also a riser lateral flange 78 that is similar to riser lateral flange 77. In this embodiment of riser 170, a top longitudinal edge 79 is optionally formed by an inwardly angled riser edge flange 82. It is noted, however, that the inwardly angled riser edge flange 82 may be a separate component that is coupled to an inside surface 76 of riser 170. To provide further structural support, riser 170 may optionally include a base flange 72 that laterally extends from the bottom of riser 170 inwardly from riser inside surface 76. Base flange 72 may be a separate flange that is connectable to riser 170 or may be formed by bending the bottom, longitudinal edge.

Figure 11:
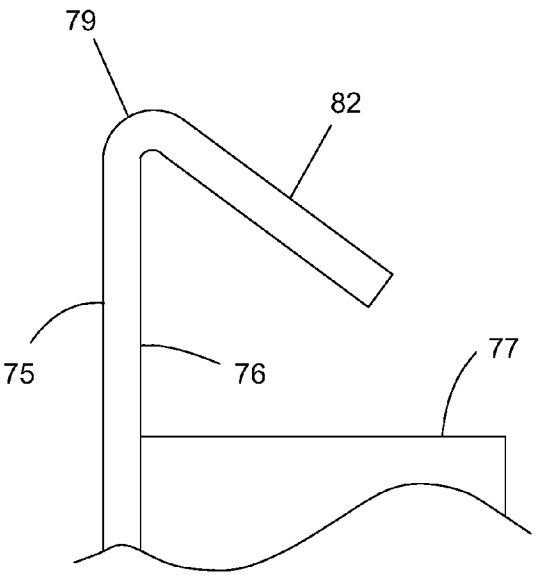
FIG. 11 is an enlarged partial view of the embodiment of the riser illustrated in FIG. 10 and showing the top, inwardly directed flange.
Figure 12:
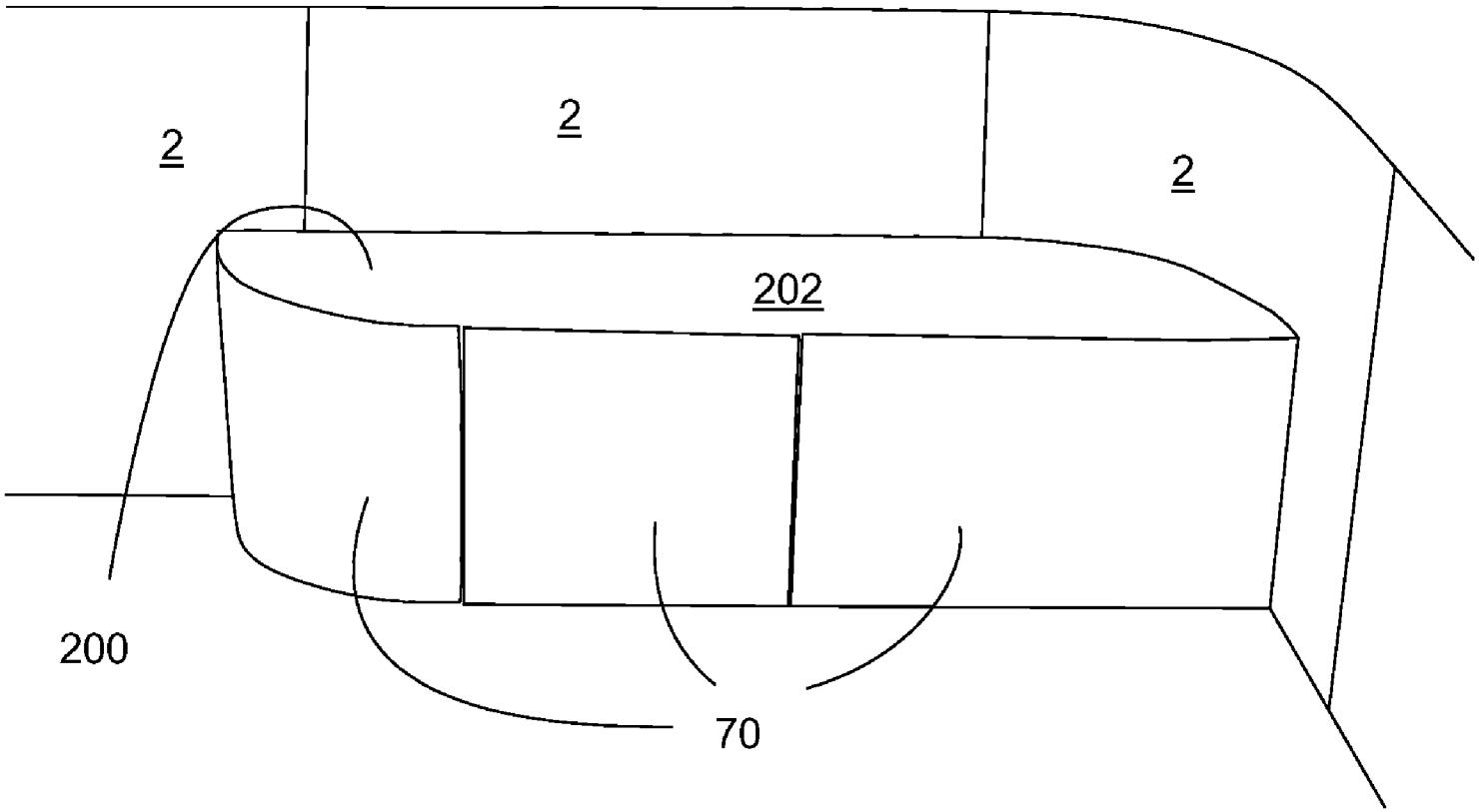
FIG. 12 is a front perspective view of the present invention illustrated in FIG. 7 showing a support filler installed in the volume space between the risers and the pool wall.

FIG. 11 shows an enlarged view of riser edge flange 82. Riser edge flange 82 is formed by bending the longitudinal side towards riser inside surface 76 forming an acute angle between riser edge flange 82 and riser inside surface 76 to present a rounded top longitudinal edge 79. As with hem 80, the purpose of riser edge flange 82 is to present a smooth riser edge transition from the smooth outside surface 75 so that no sharp edges are exposed to the pool liner (not shown) that will cover permanent form assembly 10'. FIG. 12 shows a bench-style permanent form assembly 10' with a filler 200 within space 100 and forming a bench platform 202. The bench-style form assembly shown in FIG. 12 would be ready for installation of a pool liner.

Figure 13:
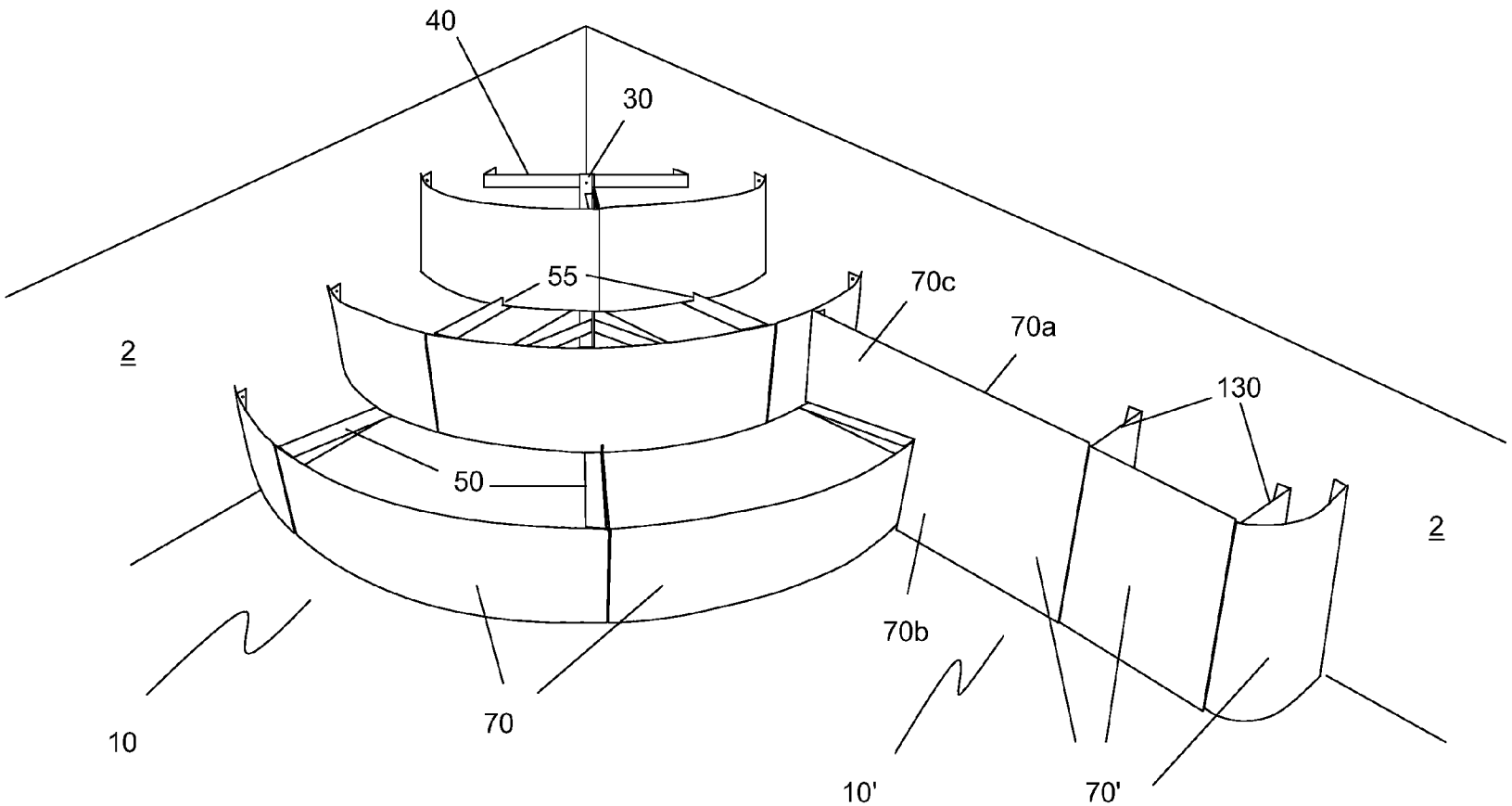
FIG. 13 is a front perspective view of the present invention showing a combination pool stairs and bench permanent forms.

FIG. 13 illustrates a combination stair-style and bench-style permanent form assembly 300. In this illustration, a corner stair permanent form assembly 10 is shown but it should be understood that the combination may also be assembled along a straight pool wall as well. Permanent form assembly 300 includes a stair-style form assembly 10 and a bench-style form assembly 10'. Stair-style form assembly 10 includes vertical elongated support 30 with support cross brace 40, a plurality of lateral braces 50 and a plurality of risers 70. Bench-style form assembly 10' includes a plurality of unitary brace and support structures 130 and a plurality of risers 70'. In this combination form assembly 300, a riser **70*a* of the plurality of risers 70' that connects to stair-style form assembly 10 has a lower portion removed to accommodate placement of a lower portion 70*b* of riser 70*a* against a step riser 70 of a lower stair and an upper portion 70*c* extending to and against a step riser 70 of a second stair. Each of the lower portion 70***b* and the upper portion 70*c* has a lateral flange for securing each portion 70*b*, 70*c* to risers 70 of the lower stair and the second stair, respectively.

Figure 14:
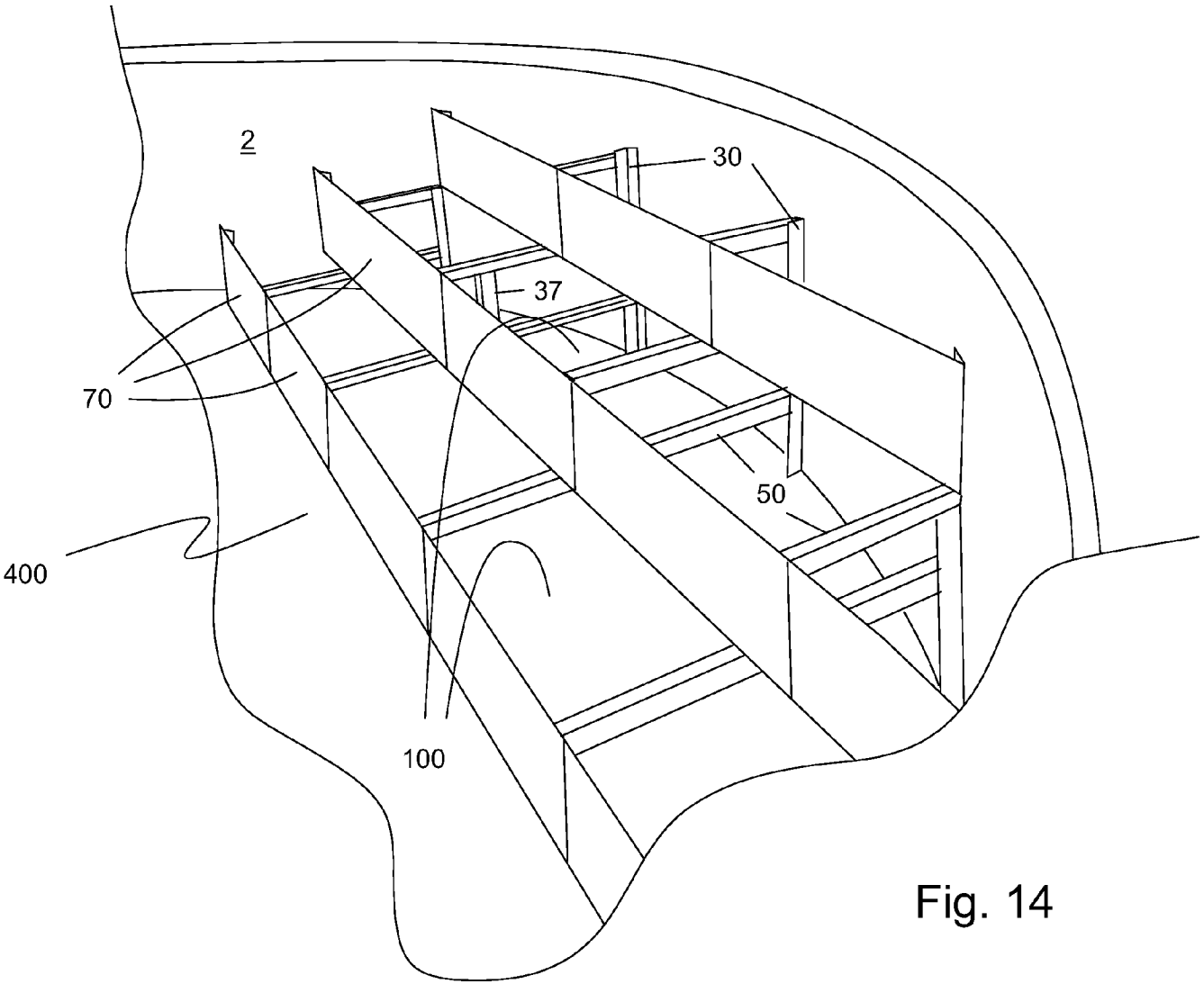
FIG. 14 is a perspective view of another embodiment of the present invention showing a pool stair permanent form with straight risers in a curved pool wall location.

FIG. 14 illustrates another embodiment of the present invention. FIG. 14 shows a permanent form assembly 400 that is a stair-style form incorporating straight stairs in a curved portion of swimming pool wall 2. This permanent form assembly 400 includes a plurality of vertical elongated supports 30, a plurality of lateral braces 50 and a plurality of risers 70. Optionally, a vertical brace support 37 may be connected between the lateral brace 50 of one step to the lateral brace 50 of a lower or upper step. As with all previous embodiments, permanent form assembly 400 creates a volume space 100 between wall 2 and inside surface 76 of the plurality of risers 70, which receives a filler (not shown) to complete the assembly prior to installing a pool liner. Additionally, the plurality of risers 70 may include top longitudinal edge 79 with an optional inwardly angled riser edge flange 82. To provide further structural support, riser 70 may further optionally include a base flange 72 that laterally extends from the bottom of riser 70 inwardly from a riser inside surface 76. Base flange 72 may be a separate flange that is connectable to riser 170 or may be formed by bending the bottom, longitudinal edge. The inclusion of optional flanges 82 and 72 on risers 70 that are used for straight-faced stairs provides additional structural support to the assembly. It should be further noted that straight stairs may also be used along straight pool walls and may further include rounded riser corners.

The preferred materials used to make or form the various components of the permanent form assembly of the present invention include stainless steel or structural composites. The only requirement is that the material used has sufficient structural strength to hold and retain the filler.

The present invention has many advantages over prior art concrete and molded swimming pool stairs and benches. The permanent form assembly 10, 10' and 400 can be packaged into a compact kit form with fasteners and instructions for easy assembly when installing an in-ground swimming pool. No special skills are required to assemble the permanent form assembly. Unlike concrete forms that must be made, set up, concrete poured into the form and allowed to set, and then the concrete forms removed, the present invention is left in place and the pool liner is disposed over the form. Unlike preformed, molded steps, no additional structural support is required after the filler is placed into the form assembly of the present invention.

A further advantage of one embodiment of the present invention is the use of bendable risers so that any shape (i.e. straight, arcuate, S-shaped, etc.) can be formed. The step risers 70 can be manufactured as one size where a stair-style assembly would simply include a plurality of risers needed for making a user-selected stair configuration, while the bench risers 70' can also be manufactured as one size. Because all of the risers 70 are flat and the curved risers are formed on site during assembly, the risers 70 are stackable along with the lateral braces 50 and the vertical elongated support 30.

Another advantage is that with a limited number of different components (i.e. 2 different risers, 3 different lateral braces for 3 stair steps, and 1 type vertical support if desired), the permanent form system or assembly of the present invention allows a large number of stair and bench styles to be assembled. Because the components are standardized, no special skills are required to manufacture a structural form. A user need only follow the assembly instructions that accompany a permanent form kit. This reduces labor costs both in respect of skill level and time required, thus, making the addition of steps/stairs and/or a bench within a swimming pool less expensive than prior art methods.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A permanent form kit for creating swimming pool user support structures within a swimming pool, the kit comprising:

one or more of a vertical elongated support having a pool wall flange extending laterally from the vertical support and adapted for fixedly securing the pool wall flange to one of a pool wall or a support brace;

one or more of a lateral brace having a longitudinal brace body, a vertical support end connected to the vertical elongated support and a riser support end wherein the lateral brace is adapted to extend laterally from the pool wall;

a plurality of support structure risers, each having a riser inside surface, a smooth riser outside surface, a first riser end, and a second riser end, the first riser end adapted for fixedly securing to the riser support end of the lateral brace and the second riser end adapted for fixedly securing to one of a first riser end of another support structure riser, the pool wall or the riser outside surface of another support structure riser; and a plurality of fasteners for fixedly securing the one or more of the vertical, elongated support, the one or more of the lateral brace and the plurality of support structure risers to each other and to the pool wall wherein the one or more of the vertical elongated support, the one or more of the lateral brace and the plurality of support structure risers when assembled create a permanent support structure form having a volume to contain the one or more of the vertical elongated support, the one or more of the lateral brace and the riser inside surface, the volume adapted for receiving a filler within the volume to form the swimming pool user support structure having a user support platform over which a pool liner is disposed.

2. The kit of claim 1 further comprising a support brace having first and second support brace ends adapted to directly attach one of the first and second support brace ends to one of a pair of intersecting pool walls and a central support brace portion adapted for fixedly attaching to the one or more of the vertical elongated support.

3. The kit of claim 1 wherein one of the one or more of the lateral brace is integrally-formed with one of the one or more of the vertical elongated support from a single piece of material.

4. The kit of claim 1 wherein the plurality of support structure risers each have a hem formed along a longitudinal edge.

5. The kit of claim 1 wherein the plurality of support structure risers each have a bracing flange formed along a longitudinal edge that extends towards the riser inside surface.

6. The kit of claim 1 wherein the first riser end and the second riser end each has a riser end flange extending laterally from the riser inside surface.

7. The kit of claim 1 wherein the one or more of the lateral brace includes a riser spacing slot adapted for receiving a longitudinal side of one of the plurality of support structure risers.

8. The kit of claim 1 further comprising a plurality of vertical brace supports adapted for attaching and supporting one or more of the lateral brace along the longitudinal body of the lateral brace.

9. A permanent form assembly for creating and forming swimming pool user support structures within a swimming pool, the permanent assembly comprising:

one or more of a vertical elongated support having a pool wall flange extending laterally from the vertical support and fixedly attached to one of a pool wall or a support brace;

one or more of a lateral brace having a longitudinal brace body, a vertical support end connected to the vertical elongated support and a riser support end wherein the lateral brace extends laterally from the pool wall; and a plurality of support structure risers, each having a riser inside surface, a smooth riser outside surface, a riser first end, and a riser second end, the riser first end fixedly attached to the riser support end of the lateral brace and the riser second end fixedly attached to one of a riser first end of an adjacent support structure riser, the pool wall or a riser outside surface of another support structure riser, wherein the one or more of the vertical elongated support, the one or more of the lateral brace and the plurality of support structure risers create a permanent support structure form having a volume that contains the one or more of the vertical elongated support, the one or more of the lateral brace and the riser inside surface, the volume adapted for receiving a filler within the volume to form a smooth swimming pool user support structure having a user support platform over which a pool liner is disposed.

10. The permanent form assembly of claim 9 wherein the plurality of support structure risers each have a hem formed along a longitudinal edge.

11. The permanent form assembly of claim 9 wherein the plurality of support structure risers each have a bracing flange formed along a longitudinal edge that extends towards the riser inside surface.

12. The permanent form assembly of claim 9 wherein the permanent form assembly and the volume when filled with the filler forms swimming pool stairs, a swimming pool bench or a combination swimming pool stairs and a swimming pool bench.

13. The permanent form assembly of claim 12 wherein the permanent form assembly for swimming pool stairs further includes a plurality of lateral braces that radially extend from one of the one or more of the vertical elongated support to form arcuate-shaped swimming pool stairs.

14. The permanent form assembly of claim 13 wherein the plurality of lateral braces includes a riser spacing slot in which is received a longitudinal side of one of the plurality of support structure risers.

15. The permanent form assembly of claim 12 wherein the volume to form swimming pool stairs communicates with the volume to form the swimming pool bench.

16. The permanent form assembly of claim 13 further includes a support brace having a first and second support brace ends directly attached to one of a pair of intersecting pool walls and a central support brace portion adapted for fixedly attaching to the one or more of the vertical elongated support.

17. A permanent swimming pool user support structure within a swimming pool, the user support structure comprising:

one or more of a vertical elongated support having a pool wall flange extending laterally from the vertical support and fixedly attached to one of a pool wall or a support brace;

one or more of a lateral brace having a longitudinal brace body, a vertical support end connected to the vertical elongated support and a riser support end wherein the lateral brace extends laterally from the pool wall;

a plurality of support structure risers, each having a riser inside surface, a riser outside surface, a riser first end, and a riser second end, the riser first end fixedly attached to the riser support end of the lateral brace and the riser second end fixedly attached to one of a riser first end of an adjacent support structure riser, the pool wall or a riser outside surface of another support structure riser wherein the one or more of the vertical elongated support, the one or more of the lateral brace and the plurality of support structure risers when assembled create a permanent support structure form having a volume; and a filler disposed within the volume of the permanent support structure form created by the plurality of support structure risers, the one or more of a lateral brace and the one or more of a vertical elongated support wherein an exposed portion of the filler is concrete and forms one or more of a user support platform over which a pool liner is disposed.

* * * * *